US012195411B2

(12) United States Patent
Davis

(10) Patent No.: US 12,195,411 B2
(45) Date of Patent: Jan. 14, 2025

(54) PYROPHORIC PELLETS THAT EMIT INFRARED RADIATION

(71) Applicant: Alloy Surfaces Company, Inc., Chester Township, PA (US)

(72) Inventor: Andrew Davis, Swarthmore, PA (US)

(73) Assignee: Alloy Surfaces Company, Inc., Chester Township, PA (US)

( * ) Notice: Subject to any disclaimer, the term of this patent is extended or adjusted under 35 U.S.C. 154(b) by 1323 days.

(21) Appl. No.: 16/513,211

(22) Filed: Jul. 16, 2019

(65) Prior Publication Data

US 2020/0407288 A1 Dec. 31, 2020

Related U.S. Application Data

(60) Provisional application No. 62/699,779, filed on Jul. 18, 2018.

(51) Int. Cl.
*C06C 15/00* (2006.01)

(52) U.S. Cl.
CPC ..... *C06C 15/00* (2013.01)

(58) Field of Classification Search
None
See application file for complete search history.

(56) References Cited

U.S. PATENT DOCUMENTS 4,871,708 A 10/1989 Baldi
4,880,483 A * 11/1989 Baldi ..... B65D 43/022 149/6
5,102,700 A 4/1992 Baldi
5,464,699 A 11/1995 Baldi
5,540,793 A * 7/1996 Bals ..... C01C 1/18 423/396
5,972,506 A * 10/1999 Leichter ..... C06C 15/00 423/119
6,193,814 B1 2/2001 Baldi
6,258,461 B1 7/2001 Baldi
8,783,186 B2 7/2014 Scanlon et al.
9,222,762 B2 12/2015 Dillard et al.
9,446,386 B2 9/2016 Durante et al.
10,059,637 B2 8/2018 Luan et al.
(Continued)

FOREIGN PATENT DOCUMENTS

DE 102010053783 A1 * 6/2012 ..... C06B 33/00
WO WO-2009077473 A1 * 6/2009 ..... C09D 133/12
WO WO-2013/016116 A1 1/2013

OTHER PUBLICATIONS

European Search Report issued on Mar. 26, 2020 for corresponding European U.S. Appl. No. 19/206,141.

*Primary Examiner* — Aileen B Felton
(74) *Attorney, Agent, or Firm* — POLSINELLI PC

(57) ABSTRACT

The present disclosure relates to pyrophoric pellets that break apart into individual particulates or agglomerates when exposed to air and emit infrared radiation. The pyrophoric pellets include: (a) about 35 to about 95 wt. % of pyrophoric particles; (b) about 0.05 to about 30 wt. % of one or more thermally expandable particles; (c) about 1 to about 40 wt. % of one or more additives that modify IR signature; and (d) optionally, one or more additives that produce smoke at a temperature of 150° C. or greater. The pyrophoric pellets are particularly useful as countermeasures to protect against incoming missiles.

19 Claims, 1 Drawing Sheet

(56) References Cited

U.S. PATENT DOCUMENTS

| | | | |
|---|---|---|---|
| 2007/0039505 | A1 | 2/2007 | Dillard et al. |
| 2009/0050245 | A1 | 2/2009 | Lay |
| 2009/0095186 | A1 | 4/2009 | Dillard et al. |
| 2011/0174183 | A1 | 7/2011 | Callaway et al. |
| 2011/0283912 | A1 | 11/2011 | Dillard et al. |
| 2012/0192750 | A1 | 8/2012 | Savrun et al. |
| 2014/0162003 | A1 | 6/2014 | Baldwin et al. |
| 2014/0208973 | A1 | 7/2014 | Dillard et al. |
| 2014/0373983 | A1 | 12/2014 | Lay |

* cited by examiner

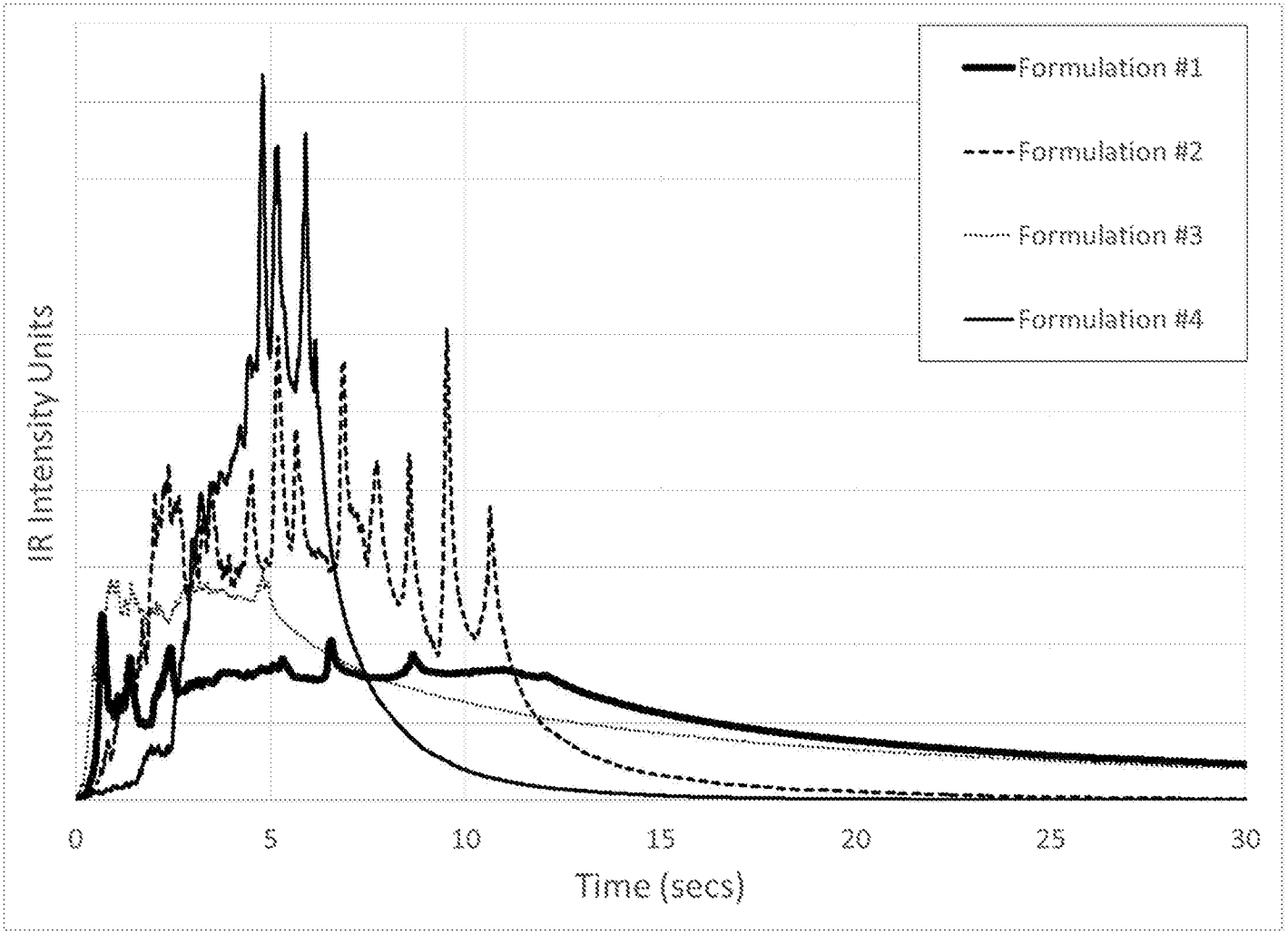
Formulation #1
Formulation #2
Formulation #3
Formulation #4
IR Intensity Units
0
5
10
15
20
25
30
Time (secs)

PYROPHORIC PELLETS THAT EMIT INFRARED RADIATION

PRIORITY INFORMATION

This application claims priority to U.S. Provisional Application No. 62/699,779 filed on Jul. 18, 2018, the entire content of which is incorporated herein by reference.

FIELD OF THE DISCLOSURE

The present disclosure relates to pyrophoric pellets that can be used as countermeasures for protecting against incoming missile threats. When exposed to the atmosphere, the pyrophoric pellets spontaneously break apart into individual particulates or agglomerates and emit infrared radiation.

BACKGROUND

Military missiles, such as air-to-air and surface-to-air guided missiles, are designed to pursue infrared (IR) radiation emitted by a target, for example, an enemy aircraft, ground vehicles, ships, etc. Flares that emit IR radiation (IR decoys) are therefore used as countermeasures to protect against incoming missiles. IR decoys can also be used preemptively to prevent the detection of a target. The IR radiation emitted by the decoy confuses the missile; the missile mistakes the IR radiation emitted by the decoy as the target and pursues the decoy (or the IR radiation emitted by the decoy) instead of pursuing the target, thereby sparing the target.

IR decoys are designed to be dispensed from cases that are standardized in size and shape for use in existing dispensing systems. As such, the design of IR decoys has been restricted to these predetermined sizes and shapes, which has limited the types of IR radiation profiles that can ultimately be realized. For example, some techniques utilize stacks of pyrophoric materials housed in square, rectangular, or circular shaped cartridges that were held in correspondingly shaped dispensers, for example, dispensers on an aircraft. Advancement of missile technology, however, has resulted in the development of missiles capable of identifying a target's unique IR signature and distinguishing it from the IR radiation emitted from typical decoys. Therefore, the development of IR decoys that are attractive to advanced missile seekers is needed. It is necessary to design the IR decoy such that the resulting signature(s) ensure that the approaching missile mistakes the decoy for the target.

Designing IR decoys having specialized IR signatures has been challenging. Merely increasing the amount of an illuminant is not always an option due to the predetermined sizes and shapes required for existing dispensing systems. Also, the reactive materials often used in these decoys include thin metal foils coated with self-igniting, pyrophoric coatings. These pyrophoric foils are often lightweight and have a high surface-to-volume ratio and therefore experience significant drag, limiting the speed and the distance of travel.

SUMMARY OF THE DISCLOSURE

The pyrophoric pellets of the instant disclosure create one or more clouds of IR radiation. Upon deployment into the atmosphere, the pellets self-ignite and break apart into individual particulates or agglomerates (i.e., the pellets disintegrate), and IR radiation is released during the process.

The pellets are designed to be kinematic or pseudo-kinematic, producing one or more infrared (IR) radiation emitting clouds that give the appearance of a moving target. Depending on the mechanism of deployments, the clouds produced by the pellets can be distributed in 3-dimensional space, in both the direction of deployment and perpendicular to the direction of deployment. The pellets are easily propelled along their trajectory because they have sufficient mass and a low surface area-to-volume ratio. Large and intense IR clouds are produced from comparatively small pyrophoric pellets. The pyrophoric pellets typically include:

- pyrophoric particles;
- thermally expandable particles that undergo volume expansion upon reaching a temperature of at least 50° C., the volume expansion being at least 3 times the particles' unexpanded volume;
- optionally, one or more additives that modify IR signature; and
- optionally, one or more additives that produce smoke at a temperature of 150° C. or greater.

The pyrophoric pellets are unique in that they can be formulated to provide an unlimited number of different IR signatures, cloud shapes, and intensities. By varying the composition of the pellets, outputs in the various signature regions can be either strengthened or eliminated. A pyrophoric material can have signatures in the ultraviolet (UV), visible, near IR (NIR), midwave IR (MWIR) and longwave IR (LWIR). Alternatively, it is possible to exclude the signature(s) in one or more of these regions by changing the composition of the pellet. In some cases, it may be desired to provide signatures only in the MWIR and LWIR.

Developments in missile technology have enabled guidance systems of missiles to discriminate and reject signatures of some conventional flares utilized in defensive countermeasures. These counter-countermeasure discriminators may be based on one or multiple properties of the signature, including spectral, temporal, and kinematic characteristics. Any detected signal that causes the decoy to be ignored by the missile's guidance system will render the decoy ineffective. The pellets of the instant case are particularly beneficial because they can be specifically formulated to provide spectral, temporal, and kinematic signatures that can be designed to defeat these advanced counter-countermeasures.

BRIEF DESCRIPTION OF THE DRAWINGS

Implementations of the present technology will now be described, by way of example only, with reference to the attached figures, wherein:

FIG. 1 shows the speed at which pellets according to the disclosure self-ignited and emitted IR radiation upon exposure to the atmosphere.

It should be understood that the various aspects are not limited to the arrangements and instrumentality shown in the drawings.

DETAILED DESCRIPTION OF THE DISCLOSURE

The pyrophoric pellets of the instant case include a unique combination of components that allow the pellets to spontaneously ignite when exposed to the atmosphere, break apart into individual particulates or agglomerates (i.e., disintegrate), and emit IR radiation. The pyrophoric pellets typically include:

(a) about 35 to about 95 wt. % of pyrophoric particles;

(b) about 0.05 to about 30 wt. % of thermally expandable particles that undergo volume expansion upon reaching a temperature of at least 50° C., the volume expansion being at least 3 times the particles' unexpanded volume;

(c) optionally, about 1 to about 40 wt. % of one or more additives that modify infrared radiation signature; and (d) optionally, one or more additives that produce smoke at a temperature of 150° C. or greater.

The ingredients of the pellets are typically uniformly combined prior to compression into a pellet and are therefore substantially uniformly dispersed amongst each other throughout the body of the pellet. In other words, the pellet typically comprises a substantially homogenous mixture of components. The powder mixture may be compressed into a pellet by any one of several consolidation methods, including in a simple die press. The compression force is chosen such that the resulting pellet is strong, but is not so compressed that the pyrophoric nature of the particles is destroyed.

In some instances, the pellets may include compressed metal foam. A metal foam is a cellular structure of a metal material (frequently aluminum) with gas or air-filled pores defining a large portion of the volume. A defining characteristic of metal foam is high porosity. Typically, only about 5% to about 40% (or about 5% to about 25%) of the volume of the metal foam is a metal material. Metal foams can be open-cell or closed-cell. Typically, open-cell metal foams are preferable for the instant application but certainly not required, as closed-cell metal foams are also useful. The metal foam may be composed of a single metal, multiple metals, metal alloy(s), etc., and may be a composite metal foam. Non-limiting examples of metal foams include aluminum metal foams, titanium metal foams, tantalum metal foams, etc.

One or more ingredient of the pellets described above (e.g., components (a), (b), (c), and/or (d)) can be combined with the metal foam or impregnated into the metal foam, and the combination pressed into a pellet. Metal foams can be useful for providing mechanical strength to the pellets. The metal material from the metal foam may form about 5 to about 50 by weight of the compressed pellet. In other words, in instances where the pellets are made using a metal foam, about 5 to about 50 wt. % of the compressed pellet may be due to the metal material of the foam. In some instances, the compressed metal foam forms about 5 to about 40%, about 5 to about 30%, about 5 to about 25% or about 5 to about 20%, or about 5 to about 10% of the weight of the pellets.

Upon deployment into the atmosphere, the outside surface of the pellet is first exposed to oxygen and the pyrophoric particles at the surface of the pellet ignite. The ignition of the pyrophoric particles at the surface of the pellet causes heat, which results in the thermally expandable particles at or near the surface of the pellet to activate (to expand) resulting in the outermost part of the pellet breaking apart. As the outermost part of the pellet breaks away, the underlying area becomes the outermost part of the pellet and is exposed to the atmosphere, ignites, and breaks away. The process continues until the entirety of the pellet disappears. This continuous process has the advantage of providing a traveling thermal signature as opposed to cloud that emanates from a single point.

The time from initial exposure to the atmosphere until complete disintegration of a pellet can vary depending on the desired result (e.g., the desired shape of the IR cloud, the desired length of burn, etc.) and based on the construction of the pellet (e.g., the size, shape, compressive force, and content of the pellet). Nonetheless, the pellets typically break apart relatively quickly, for example, within about 15 seconds from deployment into the atmosphere. In some cases, the pellet disintegrates within about 12 seconds, about 10 seconds, about 8 seconds, 6 seconds, 5 seconds, 4 seconds, 2 seconds, or 1 second. The pellets may break apart in about 100 milliseconds (ms) to about 15 seconds, about 100 ms to about 12 seconds, about 100 ms, to about 10 seconds, about 100 ms to about 8 seconds, about 100 ms to about 5 seconds, about 100 ms to about 2 seconds, about 500 ms to about 10 seconds, about 500 ms to about 8 seconds, about 500 ms to about 5 seconds, about 500 ms to about 2 seconds, after deployment into the atmosphere. In some cases, however, the pellet can be purposely designed as "delayed-release" or a "time-release" pellet, such that the pellet does not immediately ignite upon exposure to the atmosphere, but ignites at a predetermined time after deployment. This can be accomplished, for example, by using one or more coatings on the pellet that delay ignition. Furthermore, the pellet can be designed such that a single pellet releases one IR cloud or multiple IR clouds. Multiple IR clouds can be achieved by the use of one or more intermediate layers within the core of the pellet that interrupt the continuous burn of the pellet, or by forming a single pellet from a plurality of pellets that will break apart and each individually release independent clouds of IR radiation.

The size and shape of the pellets can vary. The pellets may be spherical, tablet-shaped or disk shaped, square, rectangular, conical, pyramidal, cylindrical, etc. In some instances, it can be useful for the pellets to be a shape and size that is compatible with existing countermeasure launching equipment. This eliminates the need for reconfiguring or replacing existing equipment required for deployment. The pellets of the instant case can be formed in a size and shape according to a desired effect and current needs. Pellets with higher surface areas will burn faster than pellets with less surface area. Similarly, a larger pellet will release a greater total amount of IR radiation than a smaller pellet, but may burn more slowly and for a longer duration. One way to create additional surface area for a given pellet size is to create additional access to air to the internal portion of the pellet, such as by drilling holes that pass through the entirety of the pellet.

In some instances, a plurality of small pellets may be combined in a unit or package for deployment together. The surface area of a plurality of small pellets is large and therefore the simultaneous deployment of a plurality of small pellets will quickly react with the environment to form an intense single cloud, or multiple clouds of IR radiation. Multiple pellets (e.g., two or more pellets) may be bound together for simultaneous launching into the atmosphere. For example, multiple pellets may be pressed together to form a conglomerate of pellets (a larger pellet that comprises multiple pellets) or multiple pellets may be bound together using an adhesive material such as a polymeric binder, etc. A coating may optionally be applied to prevent the conglomerate of pellets from igniting when initially deployed into the atmosphere. An explosive charge and/or mechanical device may be incorporated into the conglomerate of pellets that causes the conglomerate of pellets to break apart at a predetermined time after launch. The internal charge and/or mechanical device can break apart the conglomerate of pellets with a force sufficient to cause the individual pellets to blow apart from each other into multiple directions. Similarly, a mechanical device may be used as a decoy, wherein the mechanical device houses multiple pellets (e.g., two or more pellets). The mechanical device can protect pellets from exposure to the atmosphere until a predetermined time after launch, and may include one or more mechanisms to expel the pellets. For example, the mechanical device may include a charge or a spring mechanism that shoots or forces the pellets from the device into multiple directions.

The density of the pellets depends on the density of the individual components as well as the compression force that is used to consolidate the pellet. Typical densities are in the range of about 0.5 g/cm$^3$ to about 5 g/cm$^3$. In some cases, the density may be in the range of about 0.5 to about 4 g/cm$^3$, about 0.5 to about 3 g/cm$^3$, about 0.5 to about 2.5 g/cm$^3$, about 1 to about 5 g/cm$^3$, about 1 to about 4 g/cm$^3$, about 1 to about 3 g/cm$^3$, about 1 to about 2.5 g/cm$^3$, or about 1 to about 2 g/cm$^3$. To increase the density so as to improve the trajectory and/or distance of travel, high density powder components can be incorporated into the pellet. Examples of these include tungsten, molybdenum, hafnium, copper, nickel, and cobalt.

Regardless of the exact shape of the pellets, the size of the pellets can vary greatly. For example, in some cases, it may be desirable for the pellet to be relatively large, having a maximum height of about 2 cm to about 30 cm (about 1 inch to 12 inches), a maximum width of about 2 cm to about 30 cm (about 1 inch to 12 inches), and a maximum length of about 2 cm to about 30 cm (about 1 inch to 12 inches). In some cases, it may be desirable for the pellets to be relatively small, having a maximum height of about 2 mm to about 25 mm (about 0.1 inch to about 1 inch), a maximum width of about 2 mm to about 25 mm (about 0.1 inch to about 1 inch), and a maximum length of about 2 mm to about 25 mm (about 0.1 inch to about 1 inch). Similarly, in some instances, the pellets may have a maximum height of about 12 mm to about 100 mm (about 0.5 inches to about 4 inches), a maximum width of about 12 mm to about 100 mm (about 0.5 inches to about 4 inches), and a maximum length of about 12 mm to about 100 mm (about 0.5 inches to about 4 inches).

Pyrophoric Particles

The term "pyrophoric" is used herein to refer to an ability to spontaneously ignite upon exposure to air of the environment; it reacts spontaneously on contact with atmospheric oxygen. It does not refer to the spark-generating character of certain alloys when they are struck or filed. A "pyrophoric material" is a material that ignites spontaneously in air at or below 55° C. (130° F.). The term "pyrophoric particles" refers to particles of pyrophoric material, i.e., small fragments or units (less than 1 mm in diameter of pyrophoric materials). The pyrophoric particles can be produced, for example, by the grinding, crushing, or disintegration of a solid substance. Pyrophoric particles may also be referred to as "pyrophoric powder." The pyrophoric particles typically have an average particle size of about 1 nm to about 1 mm. In some cases the average particle size is about 10 nm to about 500 μm, about 100 nm to about 100 μm, about 500 nm to about 10 μm. The average particles size may be in the nanometer range or the micrometer range.

In some instances, the average particle size of the pyrophoric particles is in the nanometer range, e.g., from about 1 nm to about 1 μm, about 10 nm to about 1 μm, about 50 nm to about 1 μm, about 100 nm to about 1 μm, about 200 nm to about 1 μm, about 500 nm to about 1 μm, about 1 nm to about 500 nm, about 1 nm to about 400 nm, about 1 nm to about 300 nm, about 1 nm to about 200 nm, about 1 nm to about 100 nm, about 50 nm to about 500 nm, or about 50 nm to about 250 nm.

In some cases, the average particle size of the pyrophoric particles is in the micrometer ranges, e.g., about 1 μm to about 1 mm, about 1 μm to about 500 μm, about 1 μm to about 250 μm, about 1 μm to about 100 μm, about 1 μm to about 50 μm, about 1 μm to about 25 μm, about 5 μm to about 1 mm, about 5 μm to about 500 μm, about 5 μm to about 250 μm, about 5 μm to about 100 μm, about 5 to about 50 μm, about 5 to about 25 μm, about 10 to about 1 mm, about 10 μm to about 500 μm, about 10 to about 250 μm, about 10 to about 100 μm, about 10 to about 50 μm, about 10 to about 25 μm, or about 10 μm to about 20 μm.

Non-limiting examples of pyrophoric materials that can be used for the pyrophoric particles include: organo-metallic reagents (e.g., Grignard reagents), alkali earth elements (e.g., sodium, potassium, cesium), metals (e.g., Raney nickel, aluminum powder, zinc powder), metal hydrides (e.g., sodium hydride, germane, lithium aluminum hydride), alkyl metal hydrides (e.g., butyllithium, trimethylaluminum, triethylboron), metal carbonyls (e.g., nickel carbonyl, iron pentacarbonyl), and silicone halides (e.g., dichloromethylsilane).

In some instances, activated metals are particularly useful as pyrophoric particles. An "activated metal" is a metal or metal alloy that has been treated to ensure it is pyrophoric, for example, treated with an alkaline material that selectively extracts an alloying component to increase surface area. Activated metals can be prepared from metal alloys (such as Raney alloy). Common metals include, but are not limited to nickel, cobalt, copper, iron or mixtures thereof. Aluminum is often used as the alloying component because it is soluble in alkalis, but other components may also be used, in particular zinc and silicon or mixtures of these either with or without aluminum. The metal alloy can be finely milled if it has not already been produced in the desired particulate form during preparation. The aluminum (or other alloying component) is then partly or totally removed by extraction with alkalis such as, for example, a caustic soda solution (other bases such as KOH are also suitable) to activate the alloy powder. Following extraction of the aluminum, the remaining activated power has a high specific surface area (BET), for example, between 5 and 150 $m_2/g$, and is rich in active hydrogen. Accordingly, in some instances, the pyrophoric pellets of the instant disclosure include pyrophoric particles (pyrophoric powder) comprising an activated metal, for example, activated iron, activated nickel, activated copper, activated cobalt, activated magnesium, activated zirconium, an activated alloy of iron, an activated alloy of nickel, an activated alloy of copper, an activated alloy of cobalt, an activated alloy of magnesium, an activated alloy of titanium, an activated alloy of zirconium, and a mixture thereof.

One method for manufacturing pyrophoric metal particles such as iron or nickel (or Raney nickel) involves crushing a nickel/aluminium or iron/aluminium alloy to a fine powder, which is then treated with a caustic soda (NaOH) solution in order to remove the aluminum. This leaves a highly porous, un-oxidized iron or nickel powder of large surface area. The surfaces of these powders are extremely reactive and, when the particles are washed to remove the caustic soda/by-products and then dried, they will oxidize very rapidly in air attaining temperatures of around 1000° C.

The pyrophoric particles can also be recovered from metal-supported pyrophoric coatings. A pyrophoric coating is formed on the metal substrate, which is subsequently mechanically removed in the form of a powder. The metal-supported pyrophoric coating can be prepared by applying to the surface of the metal an aluminum powder or a mixture containing aluminum powder and one or more additional metal powders, for example, iron, nickel, cobalt, boron and copper. The aluminum powder or mixture of aluminum powder with other metal powders (such as iron powder) used to form the aluminide coating on the surface of the substrate can be applied as a dispersion or slurry of the metal powder(s) in a liquid. The liquid may include a binder and a solvent, which may be an organic solvent or water. Examples of preferred binder/solvent systems are nitrocellulose/acetone systems, acrylate resin/acetone systems and polyvinyl alcohol/water/normal propanol systems. The dispersion or slurry of the metal powder(s) in a liquid can be applied to the substrate by dipping, spraying, painting, coating or any other suitable technique for applying a coating of a dispersion or slurry to a substrate. When additional substances are added with the aluminum, such as the above-described substances (e.g., at least one of titanium, zirconium, boron, chromium, tantalum, phosphorous, manganese, iron, nickel, cobalt and copper), the additional substances are generally added in amounts of from 0.1 to 10% by weight, preferably from 0.1 to 5% by weight, based on the weight of the aluminum that was applied to the surface of the substrate.

Powdered lithium is a particularly useful material, inasmuch as powdered lithium ignites in air at a very low temperature. It also has an extremely low specific gravity so that pellets containing it are lighter than they would be if they contained other easily-ignited materials like zirconium. Lithium is also a very soft material so that when formed into a pellet, it can slightly flow and help anchor in place adjacent particles of other materials. Powdered sodium, powdered potassium and powdered rubidium behave very much like powdered lithium and are useful.

Powdered boron is known to have an extremely large thermal output per unit bulk, and is accordingly also a very desirable pyrophoric material. To ensure that particles of boron are pyrophoric, the boron it can be combined with other pyrophoric materials such as pyrophoric iron powder. When powdered lithium or other alkali metals are mixed with pyrophoric iron, it reduces the total energy output per unit bulk, and therefore is best used in pellets that contain powdered boron combined with other pyrophoric powders.

In some instances, the pyrophoric particles are pyrophoric iron particles, pyrophoric nickel particles, or a mixture thereof. The pyrophoric iron particles, the pyrophoric nickel particles, or the mixture thereof may also be alloyed with boron, for example about 1 to about 10 wt. %, about 1 to about 5 wt. %, or about 1 to about 3 wt. % of boron, based on the total weight of the pyrophoric particles.

In some instance, the pyrophoric particles may be derived from the pyrophoric materials (referred to as "Special Materials") disclosed in U.S. Pat. Nos. 4,435,481, 4,895,609, 4,957,421, 5,182,078, 6,093,498, and 6,193,814, which are incorporated herein by reference in their entirety.

The total amount of pyrophoric particles in the pyrophoric pellets can vary depending on the desired burn rate, IR intensity, cloud volume, etc., but is typically in an amount of about 35 to about 95 wt. %, based on the total weight of the pyrophoric pellets. In some instances, the total amount of pyrophoric particles in the pyrophoric pellets is about 40 to about 90 wt. %, about 45 to about 90 wt. %, about 50 to about 90 wt. %, about 35 to about 85 wt. %, about 40 to about 85 wt. %, about 45 to about 85 wt. %, about 50 to about 85 wt. %, about 35 to about 80 wt. %, about 40 to about 85 wt. %, about 45 to about 80 wt. %, or about 50 to about 80 wt. %, based on the total weight of the pyrophoric pellets.

Thermally Expandable Particles

"Thermally expandable particles" are particles that undergo volume expansion upon reaching a threshold temperature and are capable of substantially retaining their expanded structure. The onset temperature required to potentiate volume expansion is typically at least 50° C., although higher temperatures are common and in some cases preferable. For example, the onset temperature for expansion may be about 60° C., about 100° C., about 150° C., about 200° C., about 250° C., or higher, but is typically not higher than about 250° C. or 300° C. The degree of expansion is significant. For example, the particles typically expand from their initial size to have final volume that is multiple times that of the unexpanded volume, for example, 3, 10, 50, 100, 150, 200, 250, or 300 or more times greater than the unexpanded volume. The particles may expand from their initial size to have a final volume that is 3 to 400 times, 10 to about 400 times, 50 to 400 times, 100 to 400 times 150 to 400 times, 200 to 400 times, 250 to 400 times, 300 to 400 times, 3 to 350 times, 10 to 350 times, 100 to 350 times, 150 to 350 times, 200 to 350 times, or 250 to 300 times greater than the unexpanded volume.

Non-limiting examples of thermally expandable particles include thermally expandable microspheres, thermally expandable graphite, and mixtures thereof.

Thermally Expandable Microspheres

In some instances, the thermally expandable particles are thermally expandable microspheres. Non-limiting examples of thermally expandable microspheres include those that enclose a substance that expands by heating (such as isobutane, propane, and/or pentane) in an elastic shell. The shell of the thermally expandable microsphere is typically formed with a thermoplastic substance, a heat-melting substance, a substance that ruptures by thermal expansion, or the like, and in particular, a polymeric shell. Moreover, non-limiting examples of substances that form the shell of the thermally expandable microspheres include vinylidene chloride-acrylonitrile copolymers, polyvinyl alcohols, polyvinyl butyral, polymethyl methacrylate, polyacrylonitrile, polyvinylidene chloride, and polysulfone.

Commercially available products may be used as the thermally expandable microspheres. Non-limiting examples include: "MATSUMOTO MICROSPHERE F-30," "MATSUMOTO MICROSPHERE F-50," "MATSUMOTO MICROSPHERE F-80S," and "MATSUMOTO MICROSPHERE F-85" (made by Matsumoto Yushi-Seiyaku Co., Ltd.); and "EXPANCEL" (AkzoNobel), and in particular EXPANCEL DU series, which relates to dry, unexpanded microspheres. In some instances, the thermally expandable microspheres include those produced by AkzoNobel NV (see, e.g., https://expancel.akzonobel.com/. Detailed descriptions of various expandable microspheres and their production can be found in, for example, U.S. Pat. Nos. 3,615,972, 3,945,956, 4,287,308, 5,536,756, 6,235,800, 6,235,394 and 6,509,384, in EP 486080, EP 1054034, EP 1288272 and EP1408097, in WO 2004/072160, and in Japanese publication laid open No. 1987-286534, which are all incorporated herein by reference in their entirety.

The average particle size of the thermally expandable microspheres can vary but is typically about 1 to about 100 μm. In some cases, the average particle size of the thermally expandable microspheres is about 1 to about 75 μm, about 1 to about 50 μm, about 2 to about 100 μm, about 2 to about 75 μm, about 2 to about 50 μm, about 5 to about 100 μm, about 5 to about 75 μm, about 5 to about 50 μm, about 5 to about 25 μm, or about 10 to about 20 μm.

The onset temperature for expansion is typically about at 50° C. but can be much higher, for example, about 180° C. Typically, the thermally expandable microspheres are expandable at temperatures from about 80° C. to about 235° C. (176° F.-455° F.). When expanded, the microspheres have a diameter about 3, about 3.5, about 4, or about 5 times their original diameter resulting in their expanded volume being about 27, about 43, about 64, or about 125 greater than their unexpanded volume. In some cases, the expanded volume is at least 5, 10, 20, 30, 40, 50, 60, 70, 80, 90, or 100 times (up to about 100, 125, or 150 times) greater than the unexpanded volume.

Expandable Graphite

In some instances, the thermally expandable particles are thermally expandable graphite. Thermally expandable graphite refers to graphite having a layer lattice structure, where atoms or molecules (for example, sulfur compounds or nitrogen compounds) may be incorporated (intercalated) between the layers. Expandable graphite may also be referred to as expandable flake graphite, intumescent flake graphite, or expandable flake; and, for the purposes herein, these terms may be used interchangeably. In some cases, the expandable graphite is intercalated graphite in which an intercallant material is included between the graphite layers of graphite crystal or particle. Examples of intercallant materials include halogens, alkali metals, sulfates, nitrates, various organic acids, aluminum chlorides, ferric chlorides, other metal halides, arsenic sulfides, and thallium sulfides. In certain embodiments, the expandable graphite includes non-halogenated intercallant materials. In certain embodiments, the expandable graphite includes sulfate intercallants, also referred to as graphite bisulfate. As is known in the art, bisulfate intercalation is achieved by treating highly crystalline natural flake graphite with a mixture of sulfuric acid and other oxidizing agents which act to catalyze the sulfate intercalation. Ideally, the intercalated compound is located between every monolayer of the graphite but in reality, however, it is conceivable for certain graphite layers to have no intercalated compounds.

On heating, thermally expandable graphite undergoes three-dimensional expansion, as a result of which the intercalated compound, e.g., nitrogen or sulfur, releases $SO_2$ and/or $H_2SO_4$, and/or derivatives thereof. The onset temperature needed to potentiate volume expansion is typically at least 50° C., although higher temperatures are common and in some cases preferable. For example, the onset temperature for expansion may be about 60° C., about 100° C., about 150° C., about 200° C., about 250° C., or higher, but is typically not higher than about 250° C. or 300° C. In some instances, the expandable graphite expands at a temperature of 130° C. or more, 150° C. or more, 150° C. to 230° C., or 170 to 230° C.

In one or more embodiments, the expandable graphite may have an onset temperature for expansion ranging from about 100° C. to about 250° C., from about 160° C. to about 225° C., or from about 180° C. to about 200° C. In some cases the expandable graphite may have an onset temperature for expansion of at least 100° C., at least 130° C., at least 160° C., or at least 180° C. However, in some cases, the expandable graphite may have an onset temperature of at most 250° C., at most 225° C., or at most 200° C. Onset temperature may also be interchangeably referred to as expansion temperature and also alternatively referred to as the temperature at which expansion occurs.

The expandable graphite can have an average pre-expansion particle size of about 0.5 to about 1500 μm, about 10 to about 1500 μm, about 50 to about 1500 μm, about 100 to about 1500 μm, about 150 to about 1500 μm, about 150 to about 1000 μm, or about 150 to about 750 μm. Useful but non-limiting examples of expandable graphite include Graphite Grade #3772 (Asbury Carbons), having an average pre-expansion particle size in the range of about 250 μm to about 750 μm, and Graphite Grade #3626 having an average pre-expansion particle size in the range of about 100 μm to about 300 μm.

The expandable graphite may have a carbon content in the range of about 80% to about 99%. In some cases, however, the expandable graphite may have a carbon content of at least 80%, at least 85%, at least 90%, at least 95%, at least 98%, or at least 99% carbon. Similarly, the expandable graphite may have a sulfur content in the range from about 0% to about 8%, from about 2.6% to about 5.0%, from about 3.0% to about 3.5%. However, the expandable graphite may be characterized as having a sulfur greater than 0%, at least 2.6%, at least 2.9%, at least 3.2%, or at least 3.5%. In certain embodiments, the expandable graphite may be characterized as having a sulfur content of at most 8%, at most 5%, or at most 3.5%.

In one or more embodiments, the expandable graphite has an expansion ratio (cc/g) in the range from about 10:1 to about 500:1, at least 20:1 to about 450:1, at least 30:1 to about 400:1, or from about 50:1 to about 350:1. The expansion ratio is the quotient of expandable graphite's post heating expansion volume and original sample mass. The "units" are reported simply as "expansion ratio", "exfoliation ratio", or "heat expansion". If one performs a dimensional analysis on the expansion quotient, the units are volume/mass, which reads like a specific volume. The expandable graphite may have an expansion ratio (cc/g) of at least 10:1, at least 20:1, at least 30:1, at least 40:1, at least 50:1, at least 60:1, at least 90:1, at least 160:1, at least 210:1, at least 220:1, at least 230:1, at least 270:1, at least 290:1, or at least 300:1. In some instances, the expandable graphite may be characterized as having an expansion ratio (cc/g) of at most 350:1, and in yet other embodiments at most 300:1.

The total amount of thermally expandable particles in the pyrophoric pellets can vary but is typically about 0.05 to about 30 wt. %, based on the total weight of the pyrophoric pellets. In some instances, the total amount of thermally expandable particles in the pyrophoric pellets is about 0.5 to about 30 wt. %, based on the total weight of the pyrophoric pellets. The total amount of thermally expandable particles in the pyrophoric pellets may be about 0.05 to about 25 wt. %, about 0.05 to about 20 wt. %, about 0.05 to about 15 wt. %, about 0.05 to about 10 wt. %, about 0.5 to about 30 wt. %, about 0.5 to about 25 wt. %, about 0.5 to about 20 wt. %, about 0.5 to about 20 wt. %, about 0.5 to about 15 wt. %, about 0.5 to about 10 wt. %, about 1 to about 30 wt. %, about 1 to about 25 wt. %, about to about 20 wt. %, about 1 to about 15 wt. %, about 1 to about 10 wt. %, about 5 to about 30 wt. %, about 5 to about 25 wt. %, about 5 to about 20 wt. %, about 5 to about 15 wt. %, or about 5 to about 10 wt. %, based on the total weight of the pyrophoric pellets.

Additives that Modify IR Signature

Additives that modify the IR signature are, as the name indicates, for modifying the IR signature of the pellets. Such additives can be used to enhance the amount and/or intensity of IR radiation or they may be used to diminish the amount and/or intensity of IR radiation. Multiple additives may also be used that react with each other exothermically upon heating, for example, a thermite reaction between aluminum and iron oxide. Additives that are useful for enhancing the amount and/or intensity of IR radiation include, for example, materials that undergo an exothermic reaction. Additives that are useful for diminishing the amount and/or intensity of IR radiation include, for example, materials that undergo an endothermic reaction or simply act as a non-reactive heat sink. Additives can also be used to modify aspects of the burn profile of the pellet such as the rate of heating and the duration of the signature.

Non-limiting examples of additives that modify IR signature include aluminium, boron, carbon, lithium, silicon, magnesium, phosphorous, titanium, calcium, zirconium, sulphur, manganese, cerium, iron, zinc, tungsten, nickel, palladium, platinum, metal sulphide, a metal hydride, $SnCl_2$, organic compounds, or a mixture thereof.

Non-limiting examples of additives that enhance the amount and/or intensity of IR radiation include aluminum, boron, lithium, magnesium, titanium, zirconium, zinc, cerium, cobalt, copper, silicon, and vanadium. Non-limiting examples of additives that diminish the amount and/or intensity of IR radiation include alumina, sodium bicarbonate, silicon dioxide, silicon carbide, barium sulfate, calcium tungstate, tantalum, and tungsten. Some additives may act to both enhance and diminish IR radiation depending on the compound, the other additives in which the compound is combined, the temperature conditions, etc.

The total amount of additives that modify IR radiation signature that may be included in the pellets may vary. Nonetheless, the total amount of additives that modify IR radiation signature may be about 1 to about 70 wt. %, based on the total weight of the pellet. In some cases, the total amount of additives that modify IR radiation signature is about 1 to about 60 wt. %, about 1 to about 50 wt. %, about 1 to about 45 wt. %, about 1 to about 40 wt. %, about 1 to about 35 wt. %, about 5 to about 70 wt. %, about 5 to about 60 wt. %, about 5 to about 50 wt. %, about 5 to about 45 wt. %, about 5 to about 40 wt. %, about 5 to about 35 wt. %, about 10 to about 70 wt. %, about 10 to about 60 wt. %, about 10 to about 50 wt. %, about 10 to about 45 wt. %, about 10 to about 40 wt. %, or about 10 to about 35 wt. %, based on the total weight of the pellet.

Two or more additives that react exothermically with one another can also be incorporated into a given pellet composition. In this case, the heat from the pyrophoric reaction initiates the reaction between these additives. For example, many metals react exothermically when they form an intermetallic. Examples include but are not limited to aluminide reactions such as Fe and Al to form either $Fe_3Al$ or FeAl, Ni and Al to form either $Ni_3Al$ or NiAl, or Zr and Al to form $ZrAl_2$. Heat, and thus IR signature, can also be produced via a thermite reaction between a metal and a metal oxide such as the reaction between Al and $Fe_3O_4$ to yield $Al_2O_3$ and Fe.

Additives that Produce Smoke

The pellets described throughout the instant disclosure may optionally include one or more additives that produce smoke. Additives that produce smoke, as the name indicates, are additives that cause the pellet to produce smoke (smoke that is visible to the human eye). Non-limiting examples of additives that produce smoke include white phosphorous, red phosphorous, hexachloroethane, terephthalic acid, organic compounds including organic dyes, etc. Red phosphorous is often used to produce a white smoke. White smoke can also be generated from the combustion of aluminum with hexachloroethane and zinc oxide. Colored smokes often derive their color from organic dyes, such as anthroquinone, quinoline, substituted anthroquinones, substituted quinolone, and mixtures thereof.

Non-limiting examples of organic additives that produce smoke include triazines (e.g., melamine, acetoguanamine, benzoguanamine or blends thereof), imides (e.g., glutarimide, succinimide and/or its alkyl and alkenyl substituted derivatives, tetrachlorophthalimide, tetrabromophthalimide, phthlimide and/or its derivatives, trimellitimide and/or its esters), amides or salts, alkanolamine borate (e.g., triethanolamine borate (TEAB), triisopropanolamine borate), cyclic phosphate ester (e.g., pentaerythritol phosphate alcohol, propylene glycol phosphate, neopentyl glycol phosphate and/or its blends thereof), cationic amine salt (e.g., tetraalkyl ammonium or mixed tetraalkyl/aryl ammonium, imidazolium or guanidinium nitrate, acetate, benzoate, carbonate, phosphate, polyphosphate, borophosphate, oxalate & sulfamate salts), cyclic ester (e.g., lactide, glycolide, caprolactone, gluconolactone, butyrolactone), organic carbonate (e.g., trimethylene carbonate, ethylene carbonate, propylene carbonate, glycerin carbonate and its ester derivatives, and mixtures thereof.

The total amount of additives that produce smoke that may optionally be included in the pellets may vary depending on the amount and type of smoke desired. Nonetheless, the total amount of additives that produce smoke may be about 0.1 to about 40 wt. %, based on the total weight of the pellet. In some cases, the total amount of additives that produce smoke is about 0.1 to about 30 wt. %, about 0.1 to about 20 wt. %, about 0.1 to about 10 wt. %, about 0.1 to about 5 wt. %, about 1 to about 40 wt. %, about 1 to about 30 wt. %, about 1 to about 20 wt. %, about 1 to about 10 wt. %, or about 1 to about 5 wt. %, based on the total weight of the pellet.

Binding Agents

A binding agent (also referred to as a "binder") may optionally be used in the pellets. A binding agent may be added, for example, to prevent particles of the pellets from being easily degraded, e.g., broken down into potentially dangerous dust during the manufacturing processes. Binding agents may also increase the mechanical strength of the pellets, such as by cross-linking, and upon curing or aging react to form a cross-linked network within the pellet, thereby imparting greater mechanical strength, and aiding in pressing of the composition into a pellet. The binding agent may be modified through the use of a plasticizer that further aids in processing.

In some instances, binding agents are preferably combustible and produce low molecular weight by-products. Binding agent may include inorganic materials such as silica and/or organic materials such as organic polymers, including combustible organic polymers. Unlike inorganic binders such as silica, organic polymers do not increase the quantity of non-expandable solid combustion products. Non-limiting examples of combustible organic polymer binders include polyvinylchloride, polyvinylacetate, polyvinylalcohol and/or copolymers thereof, and epoxy or acrylate resin, epoxidized trimethylolpropane, trimethylol ethane triglycidyl ether, epoxidized soybean oil and mixtures thereof. Plasticizers may optionally be included with the binding agents. Non-limiting examples of plasticizers include dioctyl adipate, dioctyl sebacate, hydrocarbon ester tackifier, and mixtures thereof.

The total amount of binding agent that may optionally be included in the pellets may vary. Nonetheless, the total amount of binding agent may be about 0.1 to about 40 wt. %, based on the total weight of the pellet. In some cases, the total amount of binding agents is about 0.1 to about 30 wt. %, about 0.1 to about 20 wt. %, about 0.1 to about 10 wt. %, about 0.1 to about 5 wt. %, about 1 to about 40 wt. %, about 1 to about 30 wt. %, about 1 to about 20 wt. %, about 1 to about 10 wt. %, or about 1 to about 5 wt. %, based on the total weight of the pellet.

Coatings

The pyrophoric pellets of the instant disclosure may optionally be coated with one or more coatings. A coating may be used for a variety of different reasons. For example, one or more coatings may be used to delay ignition of the pellet. In other words, one or more coatings may be applied to the pellet to protect the pyrophoric particles of the pellet from immediately igniting upon release into the atmosphere, thereby resulting in a time-release pellet. The coating can be of a quality and in a quantity such that after release of the coated pellet into the atmosphere, the coating delays the combustion of the core of the pellet by restricting the amount of oxygen that is able to immediately reach the pyrophoric particles of the pellet. As small amounts of oxygen penetrate the coating after deployment into the atmosphere, the core gradually heats, until a threshold amount of the coating is melted, dissolved, or burnt away. At this point, the pyrophoric particles can fully ignite, heat, and break apart to release the intended cloud of IR radiation. Alternatively, a coating may be used merely to protect the pellet during storage from minor amounts of oxygen that may inadvertently or unintentionally come into contact with pellet. Such a coating may be of minimal thickness so as to not substantially alter the function of the pellet during use. Non-limiting examples of coatings include wax, a polyethylene, a polypropylene, a polysaccharide, a cellulose (e.g., hydroxypropyl methylcellulose, ethylcellulose, etc.), polymeric coatings, talc, calcium stearate, and mixtures thereof.

The pellets themselves can also be produced to have functionally graded layers. For example, a small pellet can be compressed using a certain powder mixture. Another powder mixture can then be compressed around this pellet such that the original pellet is now the core. Several layers can be produced using this method. Optionally, coatings can be applied between layers of pyrophoric material, such as polymer coatings and/or coatings of adhesive/binding materials. The IR radiation signature of these multilayer pellets can change as the pellet travels through the atmosphere because the pellet reacts (and therefore degrades) from the outside inward.

In one embodiment, the instant disclosure relates to a pyrophoric pellet comprising:

(a) about 35 to about 90 wt. %, preferably about 45 to about 80 wt. %, or more preferably about 50 to about 80 wt. % of pyrophoric particles, the pyrophoric particles having a mean particle size of about 1 nm to about 1 μm, about 1 μm to about 250 μm, preferably about 1 μm to about 150 μm, more preferably about 5 μm to about 100 μm, and being selected from particles of activated iron, activated nickel, activated copper, activated cobalt, activated magnesium, activated zirconium, an activated alloy of iron, an activated alloy of nickel, an activated alloy of copper, an activated alloy of cobalt, an activated alloy of magnesium, an activated alloy of titanium, an activated alloy of zirconium, or a mixture thereof;

(b) about 0.05 to about 30 wt. %, preferably about 1 to about 20 wt. %, more preferably about 5 to about 15 wt. % of thermally expandable particles that undergo volume expansion upon reaching a temperature of at least 50° C., the volume expansion being at least 3 times the particles' unexpanded volume, wherein the thermally expandable particles have a mean particles size of about 0.5 to about 1500 μm before expansion and are selected from thermally expandable microspheres, thermally expandable graphite, and a mixture thereof;

(c) optionally, about 1 to about 40 wt. %, preferably about 5 to about 40, more preferably about 10 to about 35 wt. % of one or more additives that modify infrared radiation signature, for example, magnesium, zirconium, zinc, titanium, aluminum, iron, $SnCl_2$, organic compounds, and a mixture thereof; and (d) optionally, one or more additives that produce smoke at a temperature of 150° C. or greater.

As already mentioned throughout the disclosure, the pellet may also optionally include additional components, such as one or more binding agents, one or more coatings, etc., and may be formed in the shapes, sizes, and configurations described throughout the disclosure.

In another embodiment, the instant disclosure relates to a pyrophoric pellet comprising:

(a) about 35 to about 90 wt. %, preferably about 45 to about 80 wt. %, or more preferably about 50 to about 80 wt. % of pyrophoric particles, the pyrophoric particles having a mean particle size of about 1 nm to about 1 μm, about 1 μm to about 250 μm, preferably about 1 μm to about 150 μm, more preferably about 5 μm to about 100 μm, and being selected from particles of activated iron, activated nickel, activated copper, activated cobalt, activated magnesium, activated zirconium, an activated alloy of iron, an activated alloy of nickel, an activated alloy of copper, an activated alloy of cobalt, an activated alloy of magnesium, an activated alloy of titanium, an activated alloy of zirconium, or a mixture thereof;

(b) about 0.5 to about 30 wt. %, preferably about 1 to about 20 wt. %, more preferably about 5 to about 15 wt. % of thermally expandable microspheres, wherein the thermally expandable microspheres undergo volume expansion upon reaching a temperature of at least 50° C., preferably at least 70° C., more preferably from 80° C. to about 235° C., and have:

(i) a mean particle size of about 1 to about 100 μm, preferably about 1 to about 50 μm, more preferably about 5 to about 25 μm before expansion;

(ii) a polymeric shell, for example, a polymeric shell comprising polyvinylidene chloride, acrylonitrile, polyurethane, or a mixture thereof;

(iii) a volatile material encapsulated by the polymeric shell, for example, a hydrocarbon selected from isobutene, isopentane, or a mixture thereof; and wherein the thermally expandable microspheres, when expanded, have a volume of at least 27 times greater than their unexpanded volume;

(c) about 1 to about 40 wt. %, preferably about 5 to about 40, more preferably about 10 to about 35 wt. % of one or more additives that modify infrared radiation signature, for example, magnesium, zirconium, zinc, titanium, aluminum, iron, $SnCl_2$, organic compounds, and a mixture thereof; and (d) optionally, one or more additives that produce smoke at a temperature of 150° C. or greater.

As already mentioned throughout the disclosure, the pellet may also optionally include additional components, such as one or more binding agents, one or more coatings, etc., and may be formed in the shapes, sizes, and configurations described throughout the disclosure.

In another embodiment, the instant disclosure relates to a pyrophoric pellet comprising:

(a) about 35 to about 90 wt. %, preferably about 45 to about 80 wt. %, or more preferably about 50 to about 80 wt. % of pyrophoric particles, the pyrophoric particles having a mean particle size of about 1 nm to about 1 μm, about 1 μm to about 250 μm, preferably about 1 μm to about 150 μm, more preferably about 5 μm to about 100 μm, and being selected from particles of activated iron, activated nickel, activated copper, activated cobalt, activated magnesium, activated zirconium, an activated alloy of iron, an activated alloy of nickel, an activated alloy of copper, an activated alloy of cobalt, an activated alloy of magnesium, an activated alloy of titanium, an activated alloy of zirconium, or a mixture thereof;

(b) about 0.05 to about 30 wt. %, preferably about 1 to about 20 wt. %, more preferably about 5 to about 15 wt. % of thermally expandable graphite, wherein the thermally expandable graphite undergoes volume expansion upon reaching a temperature of at least 130° C. and has:

(i) a mean particle size of about 1 to about 1500 μm, preferably about 10 to about 1250 μm, more preferably about 100 to about 750 μm;

(ii) an intercalate material between layers of graphite, the intercalate material selected from a halogen, an alkali metal, a sulfate, a nitrate, an organic acid, an aluminum chloride, a ferric chloride, a metal halide, an arsenic sulfide, a thallium sulfide, and a mixture thereof; and wherein the thermally expandable graphite, when expanded, have a volume of at least 25 times, preferably, at least 50 times, and more preferably at least 100 times greater than its unexpanded volume;

(c) about 1 to about 40 wt. %, preferably about 5 to about 40, more preferably about 10 to about 35 wt. % of one or more additives that modify infrared radiation signature, for example, magnesium, zirconium, zinc, titanium, aluminum, iron, $SnCl_2$, organic compounds, and a mixture thereof; and (d) optionally, one or more additives that produce smoke at a temperature of 150° C. or greater.

As already mentioned throughout the disclosure, the pellet may also optionally include additional components, such as one or more binding agents, one or more coatings, etc., and may be formed in the shapes, sizes, and configurations described throughout the disclosure.

Implementation of the present disclosure is provided by way of the following examples. The examples serve to illustrate the technology without being limiting in nature.

EXAMPLES

| Formulation | | 1 wt. % | 2 wt. % | 3 wt. % | 4 wt. % |
|---|---|---|---|---|---|
| Pyrophoric Particles | Activated Iron[1] | 70 | 70 | 60 | 60 |
| Thermally Expandable | Microspheres[2] | 10 | — | 10 | — |
| Particles | Graphite[3] | | 10 | | 10 |
| Additives for IR | Mg[4] | 20 | 20 | 10 | 10 |
| Modification | $SnCl_2$ | | | 20 | 20 |
| Additives for Smoke | Optional | — | — | — | — |
| | | 100% | 100% | 100% | 100% |

[1]The activated iron particles had a mean particle size of about 15 μm

[2]Expancel (951 DUX 120) (AkzoNobel)

[3]Expandable Flake Graphite 3626 (Asbury Carbons)

[4]The magnesium had a mean particles size of about 30 μm

The components of each formulation were mixed together in a glovebox environment (a sealed container having an inert environment therein). The mixture was placed into a ½" diameter metal die and mechanical pressure of 0.5 ton was applied to form a pellet. The pellets were maintained in an inert environment until use. The pellets were exposed to air utilizing a specialized test fixture that allows remote operation and the speed at which the pellets self-ignited and broke apart and emitted IR radiation was analyzed. Also, the IR intensity during the entire reaction was measured. The results are plotted in the chart of FIG. 1.

The foregoing description illustrates and describes the invention. The disclosure shows and describes only the preferred embodiments but it should be understood that the invention is capable to use in various other combinations, modifications, and environments and is capable of changes or modifications within the scope of the inventive concepts as expressed herein, commensurate with the above teachings and/or the skill or knowledge of the relevant art. The embodiments described herein above are further intended to explain best modes known by applicant and to enable others skilled in the art to utilize the disclosure in such, or other, embodiments and with the various modifications required by the particular applications or uses thereof. Accordingly, the description is not intended to limit the invention to the form disclosed herein.

As used herein, the terms "comprising," "having," and "including" (or "comprise," "have," and "include") are used in their open, non-limiting sense. The phrase "consisting essentially of" limits the scope of a claim to the specified materials or steps and those that do not materially affect the basic and novel characteristics of the claimed invention.

The terms "a," "an," and "the" are understood to encompass the plural as well as the singular.

Thus, the term "a mixture thereof" also relates to "mixtures thereof." Throughout the disclosure, if the term "a mixture thereof" is used, following a list of elements as shown in the following example where letters A-F represent the elements: "one or more elements selected from the group consisting of A, B, C, D, E, F, and a mixture thereof." The term, "a mixture thereof" does not require that the mixture include all of A, B, C, D, E, and F (although all of A, B, C, D, E, and F may be included). Rather, it indicates that a mixture of any two or more of A, B, C, D, E, and F can be included. In other words, it is equivalent to the phrase "one or more elements selected from the group consisting of A, B, C, D, E, F, and a mixture of any two or more of A, B, C, D, E, and F."

The expression "one or more" means "at least one" and thus includes individual components as well as mixtures/combinations.

Other than in the operating examples, or where otherwise indicated, all numbers expressing quantities of ingredients and/or reaction conditions can be modified in all instances by the term "about," meaning within +/−5% of the indicated number.

Some of the various categories of components identified for use in the pellets may overlap. In such cases where overlap may exist and the pellet includes two overlapping components (or more than two overlapping components), an overlapping component does not represent more than one component. For example, a compound that acts as an additive that modifies IR signature may also function to generate smoke and therefore also useful as an additive that produces smoke. Nonetheless, such a compound cannot simultaneously function as both an additive that modifies IR signature and as the additive that produces smoke in the claims.

All percentages, parts and ratios herein are based upon the total weight of the compositions of the present invention, unless otherwise indicated.

All ranges and values disclosed herein are inclusive and combinable. For examples, any value or point described herein that falls within a range described herein can serve as a minimum or maximum value to derive a sub-range, etc. Furthermore, all ranges provided are meant to include every specific range within, and combination of sub-ranges between, the given ranges. Thus, a range from 1-5, includes specifically 1, 2, 3, 4 and 5, as well as sub ranges such as 2-5, 3-5, 2-3, 2-4, 1-4, etc.

All publications and patent applications cited in this specification are herein incorporated by reference, and for any and all purposes, as if each individual publication or patent application were specifically and individually indicated to be incorporated by reference. In the event of an inconsistency between the present disclosure and any publications or patent application incorporated herein by reference, the present disclosure controls.

The invention claimed is:

1. A pyrophoric pellet comprising:

(a) about 35 to about 95 wt. % of pyrophoric particles;

(b) about 0.05 to about 30 wt. % of one or more thermally expandable particles that undergo volume expansion upon reaching a temperature of at least 50° C., the volume expansion being at least 3 times the particles' unexpanded volume, wherein the thermally expandable particles are selected from thermally expandable microspheres, thermally expandable graphite having sulfur or nitrogen intercalated therein, or mixtures thereof;

(c) optionally, about 1 to about 40 wt. % of one or more additives that modify infrared radiation signature; and (d) optionally, one or more additives that produce smoke at a temperature of 150° C. or greater;

wherein the pellet self-ignites upon exposure to atmospheric oxygen.

2. The pyrophoric pellet of claim 1, wherein the pyrophoric particles have a mean particle size of about 1 nm to about 250 μm.

3. The pyrophoric pellet of claim 1, wherein the pyrophoric particles are selected from an organo-metallic reagent, an alkali earth element, a metal, a metal hydride, an alkyl metal hydride, a metal carbonyl, a silicone halide, and a mixture thereof.

4. The pyrophoric pellet of claim 1, wherein the pyrophoric particles are activated metal particles.

5. The pyrophoric pellet of claim 4, wherein the activated metal is selected from activated iron, activated nickel, activated copper, activated cobalt, activated magnesium, activated zirconium, an activated alloy of iron, an activated alloy of nickel, an activated alloy of copper, an activated alloy of cobalt, an activated alloy of magnesium, an activated alloy of titanium, an activated alloy of zirconium, and a mixture thereof.

6. The pyrophoric pellet of claim 1, wherein the thermally expandable particles comprise thermally expandable microspheres having an average particles size of about 5 to about 100 μm and optionally comprise a polymeric shell.

7. The pyrophoric pellet of claim 6, wherein the thermally expandable microspheres comprise a polymeric shell and the polymer shell comprises polyvinylidene chloride, acrylonitrile, polyurethane, or a mixture thereof.

8. The pyrophoric pellet of claim 6, wherein the thermally expandable microspheres encapsulate a volatile material chosen from hydrocarbons.

9. The pyrophoric pellet of claim 8, wherein the volatile material volatilizes at a temperature of 50° C. or greater and causes the thermally expandable microspheres to expand, thereby increasing the volume of the microspheres.

10. The pyrophoric pellet of claim 6, wherein the thermally expandable microspheres, when expanded, have a volume of at least 27 times greater than their unexpanded volume.

11. The pyrophoric pellet of claim 1, wherein the thermally expandable particles comprise thermally expandable graphite having an average particle size of about 0.5 to about 1500 μm.

12. The pyrophoric pellet of claim 11, wherein the thermally expandable graphite undergoes volume expansion upon reaching a temperature of at least 130° C.

13. The pyrophoric pellet of claim 11, wherein the thermally expandable graphite comprises an intercalate material between layers of graphite selected from a halogen, an alkali metal, a sulfate, a nitrate, an organic acid, an aluminum chloride, a ferric chloride, a metal halide, an arsenic sulfide, a thallium sulfide, and a mixture thereof.

14. The pyrophoric pellet of claim 11, wherein the thermally expandable graphite has a carbon content of about 80 wt. % to about 99% wt. % and a sulfur content of greater than 0 wt. % to about 8 wt. %, based on the total weight of the thermally expandable graphite.

15. The pyrophoric pellet of claim 11, wherein the thermally expandable graphite, when expanded, has a volume of at least 25 times greater than its unexpanded volume.

16. The pyrophoric pellet of claim 1 comprising the one or more additives that modify infrared radiation signature, wherein the one or more additives that modify IR signature are selected from magnesium, zirconium, zinc, titanium, aluminum, iron, $SnCl_2$, organic compounds, or mixtures thereof.

17. The pyrophoric pellet of claim 1 comprising the one or more additives that produce smoke, wherein the one or more additives that produce smoke are selected from white phosphorous, red phosphorous, hexachloroethane, terephthalic acid, an organic compound, an organic dye, or mixtures thereof.

18. The pyrophoric pellet of claim 1, wherein the pellet separates into its original individual particulates or agglomerates thereof upon release into the atmosphere in less than about 30 seconds.

19. A method for making a pyrophoric pellet of claim 1 comprising:

(i) mixing components (a)-(c) and optionally (d) in an environment that is essentially free of oxygen; and (ii). compressing the mixture into a pellet.

* * * * *